United States Patent [19]

Payne

[11] 4,196,330

[45] Apr. 1, 1980

[54] COMBINATION OVEN FULLY UTILIZING THE CURRENT-SUPPLYING CAPABILITY OF A POWER SOURCE

[75] Inventor: Thomas R. Payne, Louisville, Ky.

[73] Assignee: General Electric Company, Louisville, Ky.

[21] Appl. No.: 911,544

[22] Filed: Jun. 1, 1978

[51] Int. Cl.[2] ..... H05B 9/00; H05B 11/00

[52] U.S. Cl. ..... 219/10.55 B; 219/10.55 R; 219/492; 307/38

[58] Field of Search ..... 219/10.55 B, 10.55 E, 219/10.55 R, 484, 485, 486, 492, 493; 323/23, 25; 307/38, 39, 40, 41; 328/70

[56] References Cited

U.S. PATENT DOCUMENTS

| | | | |
|---|---|---|---|
| 3,028,472 | 4/1962 | Baird | 219/10.55 B X |
| 3,081,392 | 3/1963 | Warner | 219/10.55 B |
| 3,453,415 | 7/1969 | Hermes et al. | 219/486 |
| 3,457,430 | 7/1969 | Samuelson | 307/41 |
| 3,523,170 | 8/1970 | Boehm | 219/10.55 B |
| 3,569,656 | 3/1971 | White et al. | 219/10.55 B |
| 3,717,300 | 2/1973 | Evalds | 219/486 X |
| 3,767,894 | 10/1973 | Berger | 219/485 X |
| 4,020,358 | 4/1977 | Wyland | 307/39 |

FOREIGN PATENT DOCUMENTS

| | | | |
|---|---|---|---|
| 2315208 | 10/1973 | Fed. Rep. of Germany | 307/40 |

*Primary Examiner*—B. A. Reynolds

*Assistant Examiner*—Philip H. Leung

*Attorney, Agent, or Firm*—Bernard J. Lacomis; Radford M. Reams

[57] ABSTRACT

A cooking oven having both microwave and electrical resistance heating means and which fully utilizes the capabilities of a limited-capability power source to achieve the shortest possible cooking time. The oven has a microwave energy generating system which requires less than all of the available current when operated at its full rated power level, and an electrical resistance heating element which requires substantially all of the available current when operated at its full rated power level. The oven also has a means for at least successively energizing the microwave energy generating system and the electrical resistance heating element at their respective full rated power levels. Additionally, there is a means for periodically fully energizing the electrical resistance heating element from the power source in short pulses when the microwave energy generating system is energized at its full rated power level. The pulses are of such frequency and duration that the resultant RMS current integrated over at least a period including one pulse and one interval between pulses, when added to the current drawn from the source to operate the microwave energy generating system at its full rated power level is no greater than and, preferably, substantially equal to, the current-supplying capability of the power source.

16 Claims, 7 Drawing Figures

COMBINATION OVEN FULLY UTILIZING THE CURRENT-SUPPLYING CAPABILITY OF A POWER SOURCE

BACKGROUND OF THE INVENTION

The present invention relates generally to a microwave oven having both microwave and electrical resistance heating capabilities and adapted for operation from a power source of limited current supplying capabilities and, more particularly, to such an oven which fully utilizes at all times the limited current supplying capabilities of the power source.

So called countertop microwave ovens have recently been introduced which are designed for operation from a 120 volt, 15 amp household branch circuit. To meet UL requirements, an appliance designed for operation from such a power source is limited to a maximum requirement of 13.5 amperes, which corresponds to approximately 1620 watts. This limited power source capability results in some particular problems.

Specifically, a typical countertop microwave oven microwave energy generating system requires a major portion of the available current. A typical microwave energy generating system comprises a magnetron which produces between 500 and 600 watts of output power at a frequency of 2450 MHz, as well as a suitable power supply for the magnetron. Such a system has an energy conversion efficiency in the order of 50%. In addition to the microwave energy generating system, a practical microwave oven includes a number of low power load devices such as lamps, blower motors, and control circuitry. Altogether, one particular commercially produced countertop microwave oven model draws approximately 11.2 RMS amperes from a 120 volt branch circuit when cooking with microwave energy alone.

In addition, due to the already limited power, supplementary electrical resistance heating elements, such as browning elements, should be operated so as to require substantially all of the available power.

As a result, for such an oven designed for operation from a 120 volt, 15 amp household branch circuit, as a practical matter the limited power available precludes the simultaneous energization of the microwave energy generating system and the supplementary electrical resistance heating units at their respective full rated power levels.

As one answer to the practical limitation on available power, countertop microwave ovens has resorted to a two-step cooking procedure whereby cooking by microwave energy is accomplished first, with the electrical resistance heating element de-energized. Next, the microwave energy source is de-energized and electrical resistance browning element is energized for the remainder of the cooking cycle.

As another answer to this practical limitation on available power, in accordance with the inventions disclosed and claimed in commonly-assigned copending application Ser. No. 911,555, filed May 31, 1978, by Raymond L. Dills; application Ser. No. 911,615, filed May 31, 1978, by Bohdan Hurko and Thomas R. Payne; and application Ser. No. 911,614, filed May 31, 1978, by Thomas R. Payne and Bohdan Hurko, effective microwave and electrical resistance heating is accomplished concurrently by various time ratio control systems which alternately energize the microwave energy generating system and the electrical resistance heating unit a plurality of times during each cooking operation. For a number of reasons described in more detail in those applications, this in effect time shares the available power and leads to superior cooking results.

With both the two-step cooking procedure previously employed and in the time sharing approaches described in the above-mentioned commonly-assigned copending applications, the current supplying capability of the power source is not utilized to the fullest extent possible. Since the current supplying capability is limited, it is desirable to utilize it to the fullest over an entire cooking operation so as to realize the shortest possible cooking time. More specifically, the electrical resistance heating units can quite easily be designed to draw substantially all the available current when energized. However, such close tailoring of the current requirements of the microwave energy generating system is generally not feasible from a practical point of view because the components of the microwave energy generating system are commercially available generally only in certain sizes. It is highly unlikely that the current requirements of a standard system would exactly coincide with the available current.

As a specific example, the exemplary microwave oven mentioned above requires approximately 11.2 RMS amperes when cooking with microwave energy. Since the microwave oven is intended for operation from a 120 volt line, fused to 15 amps, it could draw a maximum of 13.5 RMS amperes and still meet UL requirements. Thus under these conditions 2.3 RMS amperes are still available from the power source and, if not effectively utilized, a cooking operation which is not as fast as it otherwise might be results. However, during periods when the electrical resistance heating element is energized, the entire 13.5 RMS amperes available may be drawn for full utilization of the power source current-supplying capability.

In accordance with the invention disclosed and claimed in a commonly-assigned copending application Ser. No. 911,569, filed June 1, 1978, by Raymond L. Dills, entitled "Combination Oven For Utilizing the Capability of a Limited Power Source," the microwave oven includes a microwave energy generating system requiring less than all of the available current when operated at its full rated power level, and an electrical resistance heating element requiring substantially all of the available current when operated at its full rated power level. The oven disclosed therein additionally has a means for at least successively energizing the microwave energy generating system and the electrical resistance heating element from the power source at their respective full rated power levels. In order to better utilize the capabilities of the limited capability power source at all times during a cooking operation, there is a means for energizing the electrical resistance heating element from the power source at the reduced power level when the microwave energy generating system is energized at its full rated power level. The reduced power level is selected such that the total of the current drawn from the source which operates the microwave energy generating system at its full rated power level and of the current drawn from the source to operate the electrical resistance heating element at the reduced power level is no greater than and, preferably, substantially equal to, the power source capability. In the specific embodiment disclosed in the Dills application, the reduction in power level for the electrical resistance heating element is accomplished by reducing the voltage to the heating element by means of a step-down transformer when the microwave energy generating system is energized.

The present invention comprehends specific embodiments of the more general concepts disclosed in the aforementioned application, which specific embodiments are particularly adaptable to electronically controlled time ratio control systems such as are disclosed in the above-mentioned copending Hurko and Payne application Ser. No. 911,615, and the Payne and Hurko application Ser. No. 911,614.

SUMMARY OF THE INVENTION

Accordingly, it is an object of the invention to provide a cooking oven having both microwave and electrical resistance heating means and which effectively uses the current supplying capabilities of a power source having limited current supplying capability, and which does so inexpensively.

It is another object of the invention to supply an electrical resistance heating element at a reduced power level while a microwave energy generating system is energized at its full rated power level without requiring a transformer to reduce the voltage supplied to the electrical resistance heating element.

It is still another object of the invention to provide such an oven control circuit which is compatible with the relatively high starting currents drawn by a conventional magnetron and power supply.

In accordance with the more general aspects of the present invention, it is recognized that as a practical matter the current-supplying capability of a power source such as a household branch circuit is limited by heating of the wiring. To protect the wire, over current protective devices such as electromechanical circuit breakers or simple fuses are normally employed. Since heating of wiring and, more particularly, tripping of a conventional circuit breaker or blowing of a standard fuse, occur relatively slowly for moderate overloads, momentary current overloads are acceptable. As is well known, there are many common household devices, particularly electric motors, which draw a starting current in excess of the actual current rating of the power source. In summary, the current rating of such a power source refers to an effective current averaged over a period of time, and not the maximum momentary load current which may be drawn. This effective current is generally termed root-mean-square (RMS) current, and may be calculated using mathematical integration techniques.

Briefly stated and in accordance with a more particular aspect of the invention, these and other objects are accomplished by a cooking oven including a microwave energy generating system requiring less than all of the available current when operated at its full rated power level, and an electrical resistance heating element requiring substantially all of the available current when operated at its full rated power level. The oven additionally has a means for at least successively energizing the microwave energy generating system and the electrical resistance heating element from the power source at their respective full rated power levels. Additionally, there is a means for periodically fully energizing the electrical resistance heating element from the power source in short pulses when the microwave energy generating system is energized at its full rated power level. The pulses are of such frequency and duration that the resultant RMS current integrated over at least a period including one pulse and one interval between pulses, when added to the current drawn from the source to operate the microwave energy generating system at its full rated power level, is substantially equal to the power source current-supplying capability.

Briefly stated and in accordance with another more particular aspect of the invention, the pulses are synchronized to the incoming AC voltage waveform of the power source, and each pulse is one half AC cycle in duration. The half cycle pulses occur once every twenty-four AC half-cycles.

When the above-summarized technique is employed, the value of the RMS current resulting from the periodic pulsing of the resistance heating element may be determined from the following formula:

$$I_R = \frac{I_F}{\sqrt{n}}, \text{ where}$$

$I_R$ is the resultant RMS current;

$I_F$ is the RMS current drawn by the resistance heating element when operated at its full rated power level and supplied by full-wave AC power; and n is the inverse of the energization duty cycle.

As a specific example, a particular resistance heating element draws 11.0 RMS amperes at 120 volts when operated from full wave AC power. In a particular oven, it is desired to supply 2.3 RMS amperes from the source to the resistance heating element when the microwave energy generating system is energized. Rearranging the above equation, $$n = \left(\frac{I_F}{I_R}\right)^2 = \left(\frac{11.0}{2.3}\right)^2 = 23.7.$$

The value of n may be rounded to 24.0 for convenience. Thus, the resistance heating element may be energized for one half-cycle pulse out of every twenty-four half-cycles.

It should be noted that, while the technique described above reduces the RMS current and RMS voltage by a factor of $$\frac{1}{\sqrt{n}},$$

the power supplied to the resistance heating element is reduced by a much greater factor, $$\frac{1}{n}.$$

Thus, in the specific example, the resultant RMS current is approximately 1/5 the full current. However, the power supplied to the resistance heating element is reduced to approximately 1/25 of the full power. Nevertheless, an advantage is realized.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
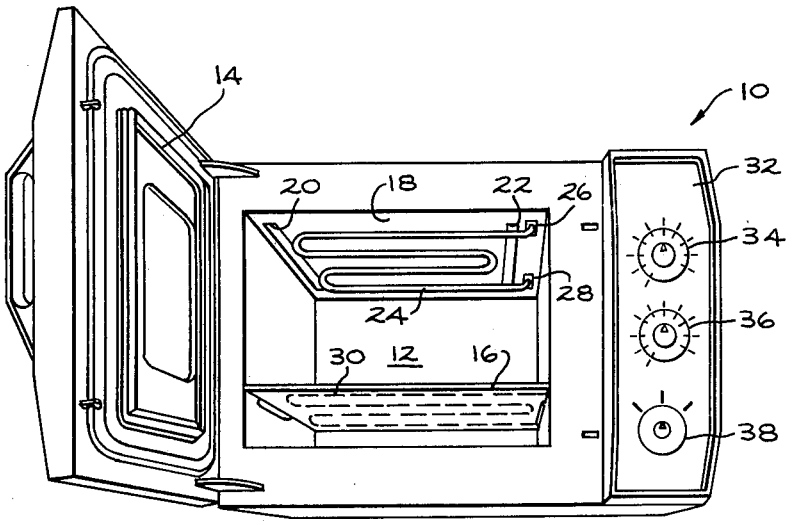
FIG. 1 is a front perspective view of a countertop microwave oven with the door open, a serpentine sheathed electrical resistance heating element located at the top of the cooking cavity, a plate-like shelf for supporting cooking utensils, and a resistive film heater applied to the shelf.

Referring first to FIG. 1, there is shown a countertop microwave oven 10 including a cooking cavity generally designated 12 and an access door 14 for closing the cooking cavity 12. For supporting food or utensils placed in the oven, a shelf 16 of dielectric sheet material is provided near the bottom of the cooking cavity 12.

The top wall 18 of the cavity 12 includes a pair of apertures 20 and 22 which couple microwave energy from a waveguide system (not shown) supplied by a magnetron (not shown) into the cavity 12. It will be appreciated that the microwave feed system illustrated is exemplary only and does not form any part of the present invention. As another example, instead of a pair of apertures 20 and 22, a single larger centrally located aperture covered by a suitable heat resistance plate (not shown) which is transparent to microwave energy might be employed.

For convenience of illustration, the oven 10 of FIG. 1 has two different forms of electrical resistance heating element illustrated. However, an actual oven will typically include only one of the illustrated heating elements. Specifically, a browning element 24 comprising a sheathed electrical resistance heating unit of serpentine configuration is positioned generally adjacent to but spaced from the top wall 18 of the cavity 12. The ends 26 and 28 of the browning element 24 are suitably terminated at the top wall 18, the electrical leads (not shown) therefrom being connected to circuitry (FIG. 3) in an electrical components compartment located generally to the right of the cooking cavity 12. The other illustrated resistance heating element is a resistive film heater applied to the underside of the dielectric shelf 16 to effect direct heating thereof. Many such heaters are known in the art and may comprise a precious metal film or a tin oxide film. Resistive film heaters may be formed either by deposition on selected areas, or by etching away selected portions of a film which initially substantially covers all of one side of the plate-like shelf 16. Compared to a sheathed electrical resistance heating element such as the browning element 24, resistive film heaters such as the heater 30 have a relatively low thermal mass and therefore heat up fairly rapidly.

A control panel 32 generally to the right of the cooking cavity 12 and forming the front of the aforementioned components compartment includes an upper control 34 to enable a user of the oven 10 to select the total duration of a cooking operation, a duty cycle control 36 to control the time ratio between the energization of the microwave energy source and the energization of the resistive heating element 24 or 30, and a mode control 38 to select either microwave cooking alone, a combination of microwave and resistive heating, or resistive heating alone.

It will be appreciated that either of the resistive heating elements 24 or 30 may readily be designed to operate at any desired power level. For example, if 11.0 RMS amperes at 120 volts is available for the heating element 24 or 30, by Ohm's law a resistance heating element may be designed to have a resistance of 11.0 ohms to draw substantially all of the available current. Such a heating element would thus require approximately 1320 watts. Due to the various low power load devices, only 11.0 and not to entire 13.5 RMS amperes of the power source is available for the heating element.

Figure 2:
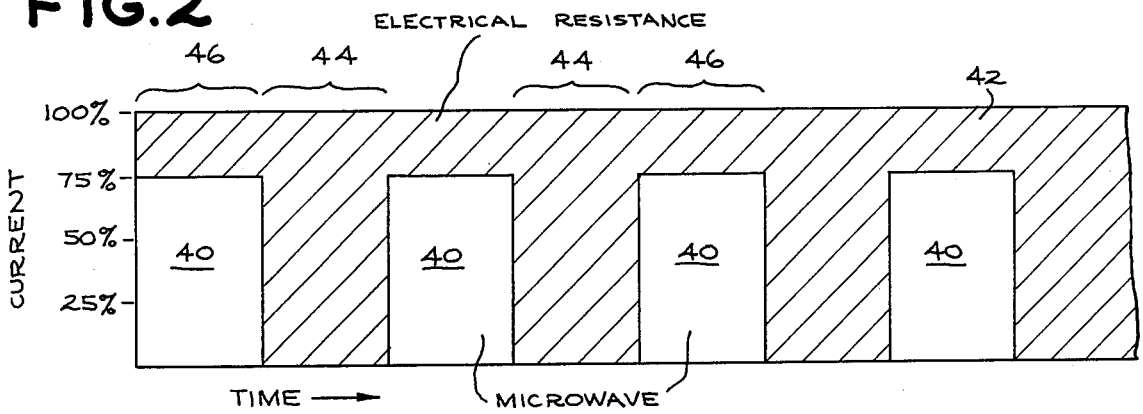
FIG. 2 is a graphical depiction of current utilization by the microwave energy generating system and the electrical resistance heating element as a function of time.

Referring now to FIG. 2, there is graphically shown as a function of time the current requirements of either of the electrical resistance heating elements 24 or 30 and of the microwave energy generating system when operated in accordance with the present invention. More specifically, the periods of energization of the microwave energy generating system are represented by unshaded blocks 40, having a height representative, in this example, of 75% of the available current. It will be appreciated that the 75% current level is an arbitrary percentage selected for the purposes of example, and that an actual microwave energy generating system will most likely require a different current. The entire shaded portion 42 of FIG. 2 represents the energization of either of the electrical resistance heating elements 24 or 30 as a function of time. During those intervals 44 when the microwave energy generating system is not required, the electrical resistance heating element 24 or 30 is operated at its full rated power level and draws 100% of the available current from the power source.

However, during those intervals 46 when the microwave energy generating system is energized at its full rated power level, the electrical resistance heating element 24 or 30 is energized at a reduced power level, the reduced power level selected such that the total of the currents required by the microwave energy generating system operated at its full rated power level (75%) and of the current supplied to the electrical resistance heating element 24 or 30 operated at its reduced power level is no greater than and, preferably, substantially equal to the power source capability (100%). Thus, in this particular example the reduced power level is selected such that the electrical resistance heating element 24 or 30 draws 25% of the available current.

With the energization pattern depicted in FIG. 2, it will be apparent that the current-supplying capability of the power source is utilized to its fullest throughout an entire cooking cycle. As previously mentioned, with an already limited power source this is of particular benefit in shortening the time required for a cooking operation.

In FIG. 2, the resistance heating element and the microwave energy generating system are alternately energized at their respective full rated power levels a plurality of times during a cooking operation. However it will be apparent that, for a two-step cooking operation, they each need to be so energized only once. For such "two-step" operation, the respective heating means are successively energized. It will also be appreciated that, during a longer alternate energization pattern, there are a plurality of successive energizations of the two heating means.

Figure 3:
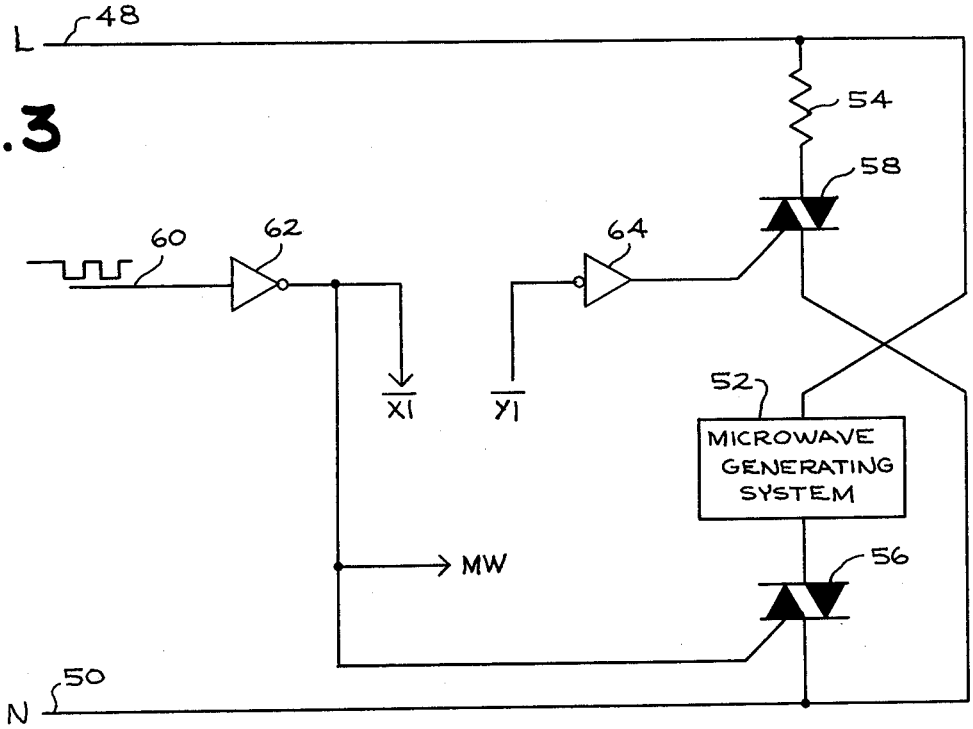
FIG. 3 is an electrical schematic diagram of a portion of one microwave oven circuit to which the invention may be applied.

Referring now to FIG. 3, there is shown a schematic diagram of one basic circuit for alternately energizing a microwave energy generating system 52 and a resistive heating element 54 which is representative of either of the heating elements 24 or 30 of FIG. 1. While only a single heating element 54 is shown, it will be appreciated that it may comprise a plurality of individual heating elements. L and N conductors 48 and 50 are connected by conventional circuitry (not shown) including the cooking operation duration control 34 (FIG. 1) so as to be energized from a 120 volt, 15 ampere household branch circuit during a cooking operation. It will be apparent that the duration of the cooking operation could be determined either by time or by temperature, as is known in the art. Omitted from FIG. 3 are various other components conventionally included in microwave ovens, such as a main power switch or relay and various safety interlock switches.

Each of the load devices 52 and 54 is interposed in series with a triac 56 and 58 and connected across the L and N conductors 48 and 50. An input conductor 60 carries a control signal to the input of an inverter 62, which has its output connected to gate the triac 56 so as to energize the microwave generating system 52 when the output of the inverter 62 is high.

Additionally taken from the output of the inverter 62 is a MW output, which is high whenever the microwave generating system 52 is to be energized.

The output of the inverter 62 is also connected, through an interrupted connection $\overline{X1}$-$\overline{Y1}$ to the input of an inverter 64, the output of which gates the triac 58 when high to energize the representative heating element 54. In FIG. 3, if the lines $\overline{X1}$ and $\overline{Y1}$ were directly connected, removing the interruption, the circuit would be similar to that of the output portion of a circuit disclosed in the above-mentioned copending Hurko and Payne application Ser. No. 911,615. In the circuit disclosed herein embodying the present invention, the connection between the inverters 62 and 64 is broken so as to allow additional control over the energization of the representative resistive heating element 54.

In FIG. 3, the input signal applied along the conductor 60 generally controls which of the load devices 54 or 56 is energized at its full rated power level. Assuming the lines $\overline{X1}$ and $\overline{Y1}$ are directly connected, when the input line 60 is high, the output of the inverter 62 is low, and the resulting logic high output of the inverter 64 gates the triac 58 to energize the representative resistive heating element 54. At the same time, the low output of the inverter 62 causes the triac 56 to be gated off. Conversely, with the input signal applied along the line 60 to the inverter 62 is low, the output of the inverter 62 is high to gate the triac 56, energizing the microwave energy generating system 52. At the same time the output of the inverter 62 is low, causing the triac 58 to be gated off. As is known, the characteristics of the triacs 56 and 58 are such that after gate drive is terminated the triac remains conducting until the load current passes through zero. With the substantially nonreactive load presented by the representative resistive heating element 54, zero load current points coincide with zero voltage points of the incoming AC waveform.

The connections to the $\overline{X1}$ and $\overline{Y1}$ lines, hereinafter described in greater detail, provide further control over the energization of the heating element 54.

Figure 4:
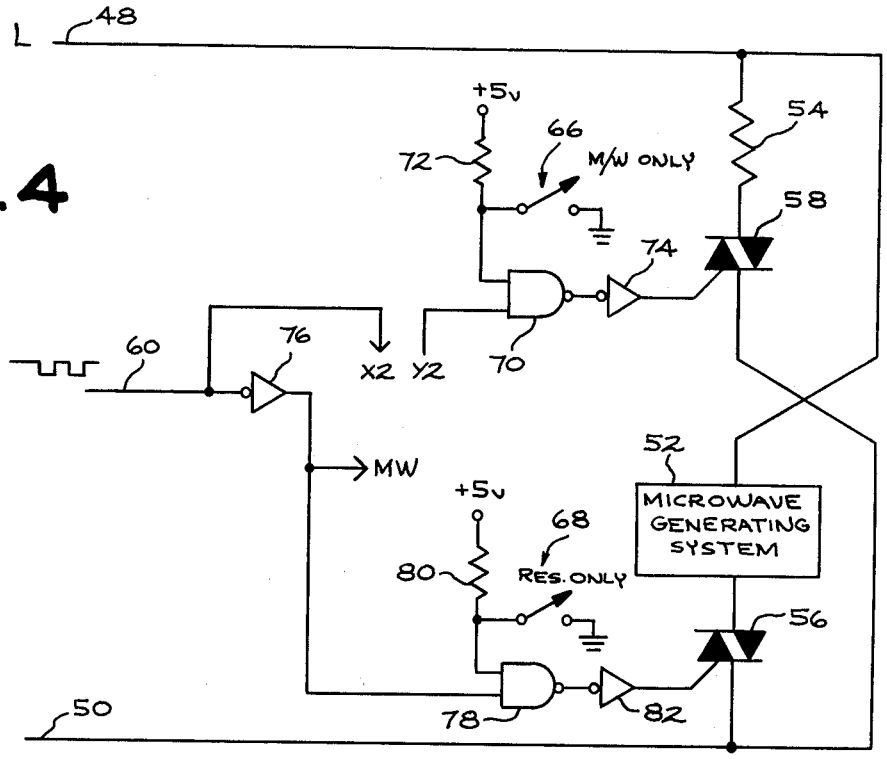
FIG. 4 is an electrical schematic diagram of a portion of another microwave oven circuit to which the invention may be applied.

In FIG. 4 a similar circuit is shown which differs primarily in that, to provide additional user control, contacts 66 and 68 of the front panel mode control 38 are connected to selectively completely disable the energization of either the resistance heating element 54 or the microwave energy generating system 52. In the particular logic circuit arrangement to permit this optional user control, the X2 and Y2 lines which are interrupted to effect further control over the energization of the heating element 54 carry a logic high signal when the triac 58 is to be gated to energize the heating element 54. The circuit of FIG. 4 is a simplified portion of a circuit described in greater detail in the above-mentioned copending Payne and Hurko application Ser. No. 911,614.

In the specifics of FIG. 4, the control signal input line 60 is connected through the interruption X2-Y2 to the lower input of a NAND gate 70. To enable the NAND gate 70 to function as an inverter, its upper input is tied through a pullup resistor 72 to a +5 volt supply. The output of the NAND gate 70 is connected through an inverter 74 to the gate of the triac 58. Thus when the line 60 control signal is high, and assuming the lines X2-Y2 are not interrupted, the NAND gate 70 is activated. The low applied to the input of the inverter 74 results in a high at the output of the inverter 74 to gate the triac 58, energizing the resistance heating element 54.

To energize the microwave generating system 52 when the line 60 control signal is low, the line 60 is also connected to an inverter 76 which supplies the lower input of another NAND gate 78, also enabled through a pullup resistor 80. The NAND gate 78 is similarly connected through an inverter 82 to gate the triac 56 when activated. In FIG. 4, the MW output is taken at the output of the inverter 76. As in the circuit of FIG. 3, MW is high when the microwave generating system 52 is to be energized. The sections 56 and 68 are connected to disable the NAND gate 70 and 78, respectively, in accordance with user input via the front panel mode control 38.

The specific connections of the mode control switch contacts 66 and 68 serve to pull the upper input of the respective NAND gate 70 or 78 low, thereby disabling the NAND gate.

Figure 5:
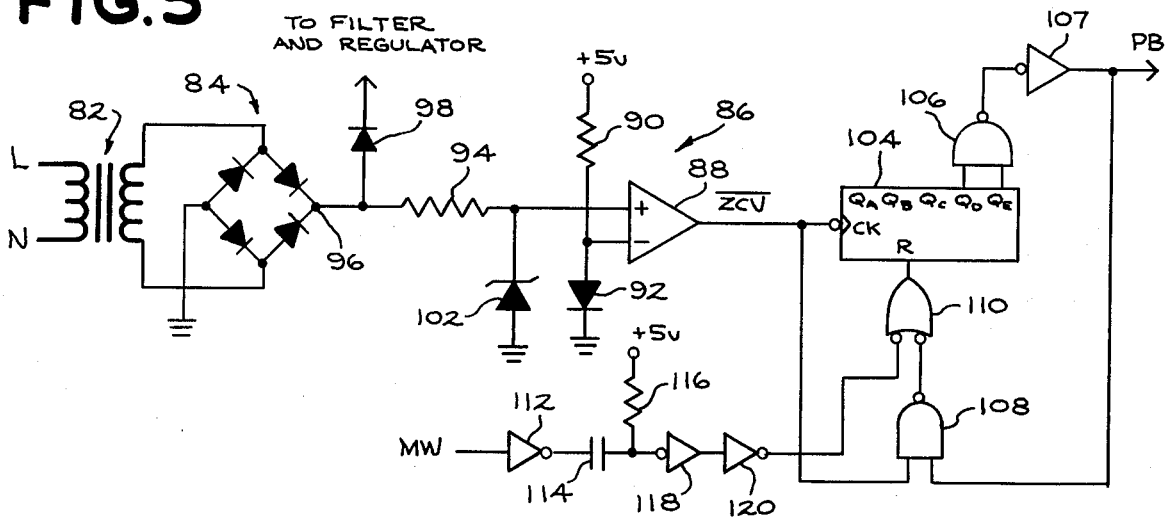
FIG. 5 is an electrical schematic diagram of a circuit according to the present invention which may be added on to either of the circuits of FIGS. 3 and 4.

Referring now to FIG. 5, there is shown a circuit according to the present invention which may be added on to either of the circuits of FIG. 3 or FIG. 4 to operate the resistance heating element 54 at a reduced power level when the microwave energy generating system 52 is energized at its full rated power level. While a specific circuit implementation of the invention is described herein, it will be appreciated that a suitably-programmed microprocessor based control system may be implemented in accordance with the invention. This is particularly so in view of the use of a simple counter in the approach described herein, which may be implemented as a microprocessor memory location which is periodically incremented and examined. In the event a microprocessor control system is already available to control the basic oven, the cost of additional programming to include the feature of the present invention will be negligible in many cases.

Referring to the specifics of FIG. 5, there are depicted the transformer 82 and bridge rectifier 84 portions of a conventional low voltage power supply (remaining portions omitted) which supplies +5 volts to the various circuit logic elements and components. A zero crossing detector, generally designated 86, generates a logic low signal on a $\overline{ZCV}$ line whenever the incoming AC voltage wave form goes through zero. In particular, the zero crossing detector 86 includes a comparator 88 having its inverting (−) input biased to an approximately 0.7 volt reference by means of a series resistor 90 and a forwardly biased silicon diode 92 connected between a +5 volt source and circuit ground. The non-inverting (+) input of the comparator 88 is connected through a current-limiting resistor 94 to the +DC output terminal 96 of the bridge rectifier 84. A diode 98 connected between the +DC output terminal 96 and omitted portions of the power supply such as a filter capacitor serves to isolate the effect of the power supply filter capacitor (not shown) from the zero crossing detector 86. To complete the zero crossing detector 86, a protective zener diode 102 prevents the voltage supplied to the non-inverting (+) input of the comparator 88 from rising above 3.3 volts.

In the operation of the zero crossing detector 86, over the major portion of the incoming AC waveform, the voltage applied to the comparator 88 non-inverting (+) input is higher than the 0.7 volt reference voltage applied to the inverting (−) input. As a result, $\overline{ZCV}$ is high. During the zero voltage crossovers of the incoming AC voltage waveform, the full wave rectified output of the bridge rectifier 84 momentarily goes to zero volts. As a result, the comparator 88 non-inverting (+) input is biased below the 0.7 volt reference, and $\overline{ZCV}$ goes low. In the particular circuit, $\overline{ZCV}$ is low for approximately five electrical degrees.

In order to generate a signal to periodically energize the electrical resistance heating element 54 with short pulses of full energization when the microwave energy generating system 52 is energized at its full rated power level, a digital counter 104 has its lock (CK) input connected to the $\overline{ZCV}$ line, and an output arrangement connected to supply a PB line. More specifically, in the particular embodiment illustrated, the counter and the output arrangement thereof supplies a momentary PB pulse once every twenty-four incoming $\overline{ZCV}$ clock pulses. The counter 104 is a five-bit binary counter, with the two most significant bit outputs ($Q_D$ and $Q_E$) connected to the inputs of a NAND gate 106, the output of which supplies the PB line through an inverter 107. Assuming the counter 104 starts at a count of zero, in accordance with the usual binary counting sequence after twenty-four incoming pulses on the $\overline{ZCV}$ line, both the $Q_D$ and the $Q_E$ outputs, and thus the PB line, are high. As indicated by the state indicator on the clock input CK, the counter 104 is clocked on a high to low transition, and thus is clocked at the beginning of each logic low $\overline{ZCV}$ pulse.

In order to reset the counter 104 to a count of zero after a PB pulse has been output, the PB line and the $\overline{ZCV}$ line are connected to the inputs of a NAND gate 108, the output of which in turn is applied to an input of a low activated OR gate 110. The output of the low activated OR gate 110 is applied to the reset (R) input of the digital counter 104.

In operation, as $\overline{ZCV}$ repetitively goes low, the counter 104 is clocked through its binary counting sequence. When $\overline{ZCV}$ goes low and the counter 104 reaches a count of twenty-four, PB goes high. This logic high is also applied to an input of the NAND gate 108. When the $\overline{ZCV}$ again goes high, the NAND gate 108 and the low activated OR gate 110 are both activated, resetting the counter 104 to a count of zero, ready to be incremented to a count of one upon the occurrence of the next $\overline{ZCV}$ pulse.

A means for delaying the first pulse to the heating element 54 following energization of the microwave energy generating system 52 will next be described. As is known, a conventional microwave energy generating system 52 comprising a permanent magnetron supplied by a ferroresonant transformer—halfwave voltage doubler supply draws a very high starting current. In the case of a cold start (when the magnetron high voltage and the heater voltage are turned on at the same time), momentary peaks as high as 100 amperes may occur. Normally, the magnetron power supply reaches its steady state condition after approximately one full AC cycle. Since the present invention relies upon a principle of applying momentary current overloads, it is important that the momentary current overload as a result of the present invention does not coincide with the starting current of the microwave energy generating system 52.

To accomplish this delay, in the specific circuit of FIG. 5 the counter 104 is reset upon energization of the microwave energy generating system 52. Specifically the MW signal from either FIG. 3 or FIG. 4 is connected to the input of an inverter 112, the output of which supplies a differentiator comprising a series capacitor 114, with a resistor 116 connecting the other terminal of the capacitor 114 to the +5 volt supply. A pair of series connected inverters 118 and 120 are connected to the other input of the low activated OR gate 110.

In operation, whenever MW goes high, the output of the inverter 112 goes low. A logic low spike is momentarily coupled through the capacitor 114 to activate the inverters 118 and 120 and the low activated OR gate 110. The spike is terminated as the capacitor 114 charges through the resistor 116.

Figure 5A:
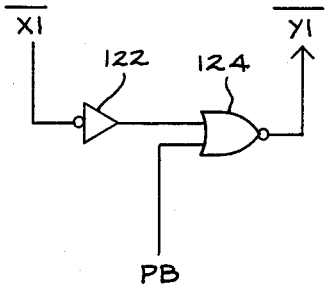
FIG. 5*a* is a diagram of a circuit to interface the FIG. 5 circuit to the FIG. 3 circuit.

Referring now to FIGS. 3 and 5*a*, the manner in which the circuit of FIG. 5*a* interfaces the circuit of FIG. 5 to the circuit of FIG. 3 will be described. In FIG. 3, a logic low at the $\overline{X1}$-$\overline{Y1}$ interruption is the active signal state which ultimately energizes the representative resistance heating element 54. In FIG. 5*a*, the $\overline{X1}$ line is applied to the input of an inverter 122, the output of which is connected to the upper input of a NOR gate 124. The output of the NOR gate 124 supplies the $\overline{Y1}$ line, returning the signal to the circuit of FIG. 3. Additionally, the PB line from FIG. 5 is applied to the lower input of the NOR gate 124. In operation, when PB is low, The $\overline{X1}$-$\overline{Y1}$ interruption behaves as a direct connection. When $\overline{X1}$ is low, the inverter 122 and the NOR gate 124 are both activated, and $\overline{Y1}$ is low. When $\overline{X1}$ is high, the inverter 122 and the NOR gate 124 are both inactive, and $\overline{Y1}$ is high, de-energizing the resistance heating element 54. The connection of the PB line to the NOR gate 124 allows the NOR gate 124 to be activated to gate the triac 58, even though the signal input line 60 is high.

Figure 5B:
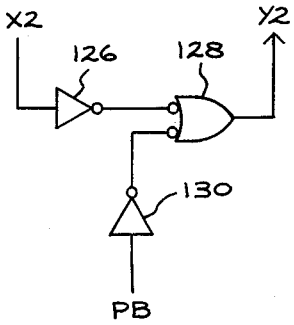
FIG. 5*b* is a diagram of a circuit to interface the FIG. 5 circuit to the FIG. 4 circuit.

Referring to FIGS. 4 and 5*b*, a similar interfacing arrangement is shown, differing only in that it is active high signal which is interrupted at X2-Y2 to ultimately cause energization of the resistance heating element 54. In FIG. 5*b*, an inverter 126 and a low activated NOR gate 128 have the same functions as the inverter 122 and the NOR gate 124 of FIG. 5*a*, only the logic polarities are reversed. Due to the reversal of logic polarity, another inverter 116 is required between the PB line and the lower input of the low activated NOR gate 128.

The following table lists component values which are suitable in the circuits described herein. In would be appreciated that these component values as well as the circuits themselves are exemplary only and are provided to enable the practice of the invention with a minimum amount of experimentation.

TABLE

| | |
|---|---|
| Resistors | |
| 72, 80, 90, 94, 116 | 10 K ohm |
| Capacitor | |
| 114 | 0.1 mfd. |
| Semiconductor Devices | |
| 56, 58 | G.E. Type No. SC160DX4 triac |
| 88 | National LM311 integrated circuit operational amplifier |
| 92 | Type No. 1N914 diode |
| 102 | 3.3 volt Zener diode, Type No. 1N4728 |
| 76, 107, 112, 118, 120, 122, 126, 130 | TTL inverters included in Texas Instruments Type No. SN7404 hex inverter packages |
| 62, 64, 74, 82 | Each is 3 parallel inverters in SN7404 integrated circuit package, with 120 ohm output pullup resistors tied to +5 volts. |
| 70, 78, 106, 108, 110, 128 | TTL NAND gates included in Texas Instruments SN7400 quadruple 2-input NANG gate integrated circuit package |
| 124 | TTL NOR gate included in Texas Instruments SN7402 quadruple 2-input NOR gate integrated circuit package |
| 104 | Two cascaded Texas Instruments SN7493 TTL integrated circuit 4-bit binary counters |

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A cooking oven which has both microwave and electrical resistance heating means, which is adapted for operation from a power source of limited current-supplying capability insufficient to concurrently supply both heating means at their respective fully rated power levels, and which comprises:

said microwave heating means being a microwave energy generating system requiring less than all of the available current when operated at its full rated power level;

said resistance heating means being an electrical resistance heating element requiring substantially all of the available current when operated at its full rated power level;

means for successively energizing said microwave energy generating system and said electrical resistance heating element from the power source at their respective full rated power levels; and means for periodically fully energizing said electrical resistance heating element from the power source in short pulses when said microwave energy generating system is energized at its full rated power level, the pulses being of such frequency and duration that the resultant RMS current obtained by integrating the instantaneous current over at least a period including one pulse and one interval between pulses when added to the current drawn from the source to operate said microwave energy generating system at its full rated power level is no greater than the power source current-supplying capability.

2. A cooking oven according to claim 1, wherein the resultant RMS current is substantially equal to the power source current-supplying capability.

3. A cooking oven according to claim 1, which is adapted for operation from an AC power source, and wherein the pulses are synchronized to the incoming AC voltage waveform.

4. A cooking oven according to claim 3, wherein each pulse is one-half AC cycle in duration.

5. A cooking oven according to claim 3, wherein said means for periodically energizing said resistance heating element in short pulses comprises a digital counter connected to count zero crossings of the incoming AC voltage waveform and to output a signal after every n counts to energize said resistance heating element for one-half of an AC cycle, whereby the resultant RMS current is equal to the heating element full power level current divided by $\sqrt{n}$.

6. A cooking oven according to claim 1, which is adapted for operation from an AC power source, wherein said microwave energy generating system draws a substantial startup current, and which further comprises a means for delaying the first pulse following energization of said microwave energy generating until said microwave energy generating system is drawing its steady state current from the power source.

7. A cooking oven according to claim 6, wherein said microwave energy generating system draws a substantial start up current for approximately one full cycle of the incoming AC voltage waveform.

8. A cooking oven according to claim 7, wherein said means for periodically energizing said resistance heating element in short pulses comprises:

a digital counter connected to count zero crossings of the incoming AC voltage waveform and to output a signal after every n counts to energize said resistance heating element for one-half of an AC cycle, whereby the resultant RMS current is equal to the heating element full power level current divided by $\sqrt{n}$; and means for resetting said digital counter to its initial count upon energization of said microwave energy generating system.

9. A cooking oven according to claim 1, wherein there are a plurality of successive energizations of said microwave energy generating system and said electrical resistance heating element at their respective full rated power levels during a cooking operation.

10. A cooking oven according to claim 9, wherein the resultant RMS current is substantially equal to the power source current-supplying capability.

11. A cooking oven according to claim 9, which is adapted for operation from an AC power source, and wherein the pulses are synchronized to the incoming AC voltage waveform.

12. A cooking oven according to claim 11, wherein each pulse is one-half AC cycle in duration.

13. A cooking oven according to claim 11, wherein said means for periodically energizing said resistance heating element in short pulses comprises a digital counter connected to count zero crossings of the incoming AC voltage waveform and to output a signal after every n counts to energize said resistance heating element for one-half of an AC cycle, whereby the resultant RMS current is equal to the heating element full power level current divided by $\sqrt{n}$.

14. A cooking oven according to claim 9, which is adapted for operation from an AC power source, wherein said microwave energy generating system draws a substantial startup current, and which further comprises a means for delaying the first pulse following energization of said microwave energy generating system until said microwave energy generating system is drawing its steady state current from the power source.

15. A cooking oven according to claim 14, wherein said microwave energy generating system draws a substantial start up current for approximately one full AC cycle of the incoming voltage waveform.

16. A cooking oven according to claim 15, wherein said means for periodically energizing said resistance heating element in short pulses comprises:

a digital counter connected to count zero crossings of the incoming AC voltage waveform and to output a signal after every n counts to energize said resistance heating element for one-half of an AC cycle, whereby the resultant RMS current is equal to the heating element full power level current divided by $\sqrt{n}$; and means for resetting said digital counter to its initial count upon energization of said microwave energy generating system.

* * * * *